United States Patent [19]

Meatto et al.

[11] Patent Number: 4,679,814

[45] Date of Patent: Jul. 14, 1987

[54] RANDOMLY ORIENTED REINFORCING FIBERS IN A SNOW SKI

[75] Inventors: Franklin D. Meatto, Cromwell; Edward D. Pilpel, Manchester, both of Conn.

[73] Assignee: TriStar Sports Inc., Middletown, Conn.

[21] Appl. No.: 804,320

[22] Filed: Dec. 3, 1985

Related U.S. Application Data

[63] Continuation of Ser. No. 574,443, Jan. 27, 1984, abandoned.

[51] Int. Cl.[4] ..... A63C 5/12

[52] U.S. Cl. ..... 280/610

[58] Field of Search ..... 280/601, 610; 441/68; 428/47, 48, 229

[56] References Cited

U.S. PATENT DOCUMENTS

| | | | |
|---|---|---|---|
| 2,648,543 | 8/1953 | Grabowski | 280/11.13 |
| 3,635,482 | 1/1972 | Holman | 280/610 |
| 3,902,732 | 9/1975 | Fosha, Jr. et al. | 280/610 |
| 4,035,000 | 7/1977 | Lacroix | 280/610 |
| 4,383,701 | 5/1983 | Hirnbock | 280/610 |
| 4,412,687 | 11/1983 | Andre | 280/610 |
| 4,455,037 | 6/1984 | Alpel et al. | 280/610 |

FOREIGN PATENT DOCUMENTS

| | | | |
|---|---|---|---|
| 2655665 | 6/1977 | Fed. Rep. of Germany | 280/610 |
| 3003537 | 8/1980 | Fed. Rep. of Germany | 280/610 |
| 2941949 | 4/1981 | Fed. Rep. of Germany | 280/610 |

*Primary Examiner*—David M. Mitchell

*Attorney, Agent, or Firm*—Ralph D'Alessandro; Thomas P. O'Day

[57] ABSTRACT

In a downhill snow ski there is provided at least one torsional reinforcing layer intermediate to the top and the bottom running surface and generally parallel thereto formed from fibers of high elastic modulus which are randomly oriented in a matrix material to increase the torsional stiffness of the ski.

18 Claims, 4 Drawing Figures

RANDOMLY ORIENTED REINFORCING FIBERS IN A SNOW SKI

This application is a continuation of application Ser. No. 574,443 filed Jan. 27, 1984 and now abandoned.

BACKGROUND OF THE INVENTION

This invention relates to a ski structure and more specifically, it is concerned with at least one torsional reinforcing layer found between the top surface and the opposing bottom or running surface of the ski to obtain torsional stiffness in the ski.

The continued popularity of downhill skiing has focused attention on the structure of skis to produce a ski that provides greater responsiveness to the improved skiing techniques being employed by skiers today and the increased speed being achieved as a result of these techniques. This continued popularity has caused the materials used in skis to be changed in response to efforts to develop higher performance skis at lower manufacturing costs. Skis have been made solely from wood, composite wood-plastic materials, as well as entirely from plastics. Skis made entirely from metal have also been manufactured, as well as incorporating metal into composite wood-plastic skis or into all plastic skis. In particular, the advent of high performance wood-fiberglass and fiberglass-plastic foam skis has intensified the skiing industry's efforts to solve the problem of providing a ski constructed of quality materials which provide increased ski return rates, increased natural frequency, increased torsional stiffness, and a bottom steel running edge with increased impact resistance.

Different approaches have been taken in attempts to solve these problems as higher performance skis have evolved in the ski industry. Initially, skis were made with just a wooden core. A core made of plastic material, such as plastic foam or urethane, placed within a honeycomb structure formed from aluminum, was employed for a limited time. Historically, skis have been manufactured by laminating, torsion box or reaction injection molding processes. However, because of the higher performance nature of today's skis, these composite skis are subjected to greater flexibility strains which the aforementioned constructions have either failed to withstand or have provided skis which produce a dead sensation to the user.

None of the aforementioned structures have provided skis which balance the considerations of high material costs, difficulty in contouring the skis during manufacture and other problems and inefficiencies that occur during the molding and assembly processes employed in the manufacture of snow skis today. Similarly, no design has been able to maintain a desired flexual pattern, while allowing for a designed torsional response. The optimum or desired design employs a thinner ski that utilizes less material to produce a lighter and livelier ski.

Prior skis using a torsional reinforcing laminate layer typically employed a ±45 degree oriented bias ply fiberglass laminate. This type of a torsionally reinforcing layer has the predominant mechanical properties affecting torsional stiffness only along the ±45 degree axes, and not through a complete 360 degrees. This desire to obtain a truly isotropic torsional reinforcing layer, that is a layer that exhibits the same torsional stiffness values as measured by the modulus of elasticity of the laminate, when measured along axes in all directions or through 360 degrees was also spurred by the desire to reduce the thickness of the layer employed and the concomitant manufacturing costs. A truly isotropic reinforcing layer permits very minute torsional stiffness increases or decreases by varying the layer's thickness by as little as 0.1 millimeter or by altering the elastic modulus properties. These increases or decreases can be termed designably variable.

Use of ±45 degree oriented bias ply fiberglass laminate also can create substantial manufacturing problems if the fiberglass is not accurately oriented along the ±45 degree axes of the skis. Inaccurate orientation produces geometric warpage of the skis.

The foregoing problems are solved in the design of the present invention by providing a torsional reinforcing layer intermediate the top surface and the bottom running surface that employs randomly oriented fibers to obtain a livelier ski with increased torsional stiffness by optimizing the longitudinal flex, the vibrational characteristics and the torsional stiffness of the ski through adjustment of the thickness of the reinforcing laminate layer and the torsional stiffness of the layer based on the type and amount of the random fibers added to the reinforcing layer.

SUMMARY OF THE INVENTION

It is an object of the present invention to provide in a downhill snow ski a torsional reinforcing layer that is isotropic in all directions through 360 degrees to form a ski with increasable or decreasable torsional stiffness.

It is another object of the present invention to provide in a downhill snow ski a torsionally reinforcing laminate layer that can be varied by choice of fiber type and/or thickness to permit adjustment of the longitudinal flex, vibration characteristics and torsional stiffness to optimize the performance characteristics of the ski.

It is a feature of the present invention to provide at least one torsional reinforcing layer in a snow ski made from randomly oriented fibers of high elastic modulus suspended in a matrix between the top surface and the bottom running surface of the ski.

It is another feature of the present invention that the randomly oriented high modulus fibers are suspended in an epoxy or polyester matrix.

It is an advantage of the present invention that the improved ski structure provides designably variable torsional stiffness.

It is another advantage of the present invention-that the improved ski structure provides increased cross strength.

It is still another advantage of the present invention that a higher bottom impact strength is obtained when the torsional reinforcing laminate layer is located beneath the core of the ski.

It is yet another feature of the present invention that the random fiber oriented torsional reinforcing layer is lower in cost than conventional reinforcing layers.

These and other objects, features and advantages are obtained by providing in a snow ski at least one torsional reinforcing layer positioned intermediate the top surface and the bottom running surface of the ski and generally parallel thereto extending at least partially between the first opposing side and the second opposing side, the at least one torsional reinforcing layer being formed from fibers of high elastic modulus suspended in a matrix of predetermined material, the fibers being randomly oriented therein to thereby permit the torsional stiffness of the ski to be adjusted.

BRIEF DESCRIPTION OF THE DRAWINGS

The advantages of this invention will become apparent upon consideration of the following detailed disclosure of the invention, especially when it is taken in conjunction with the drawings wherein.

DETAILED DESCRIPTION OF THE PREFERRED EMBODIMENT

Figure 1:
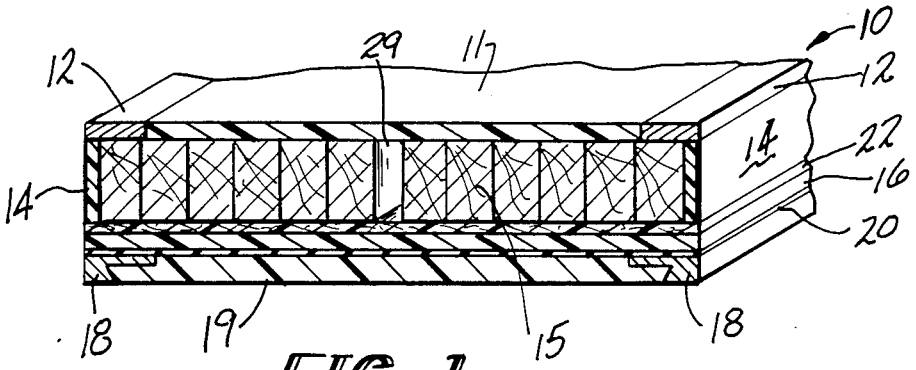
FIG. 1 is an end perspective view of a snow ski incorporating the structure of the present invention with the top surface removed.
Figure 2:
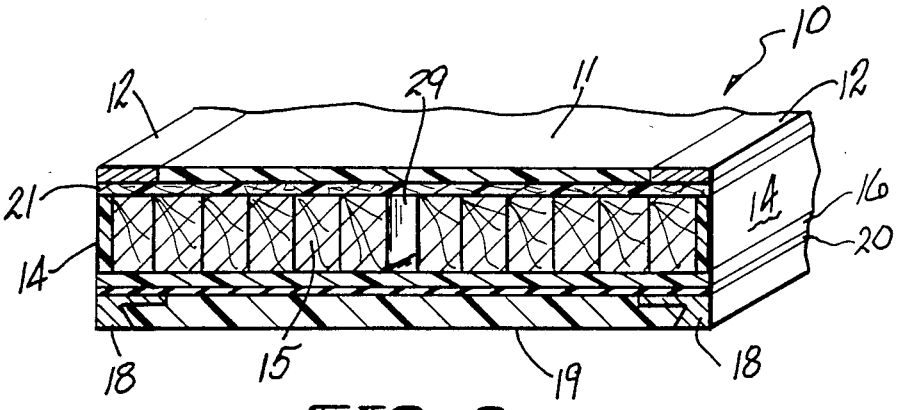
FIG-2 PRIOR ART
FIG. 2 is an end perspective view showing an alternate embodiment of the improved ski structure of the present invention with the top surface removed.

Referring to FIGS. 1 and 2 there are seen in end perspective views a snow ski 10 having a top material (not shown) of plastic or metal for decorative purposes. Also shown are a top laminate surface 11 formed from a facing material of high elastic modulus, top edges 12 formed from a plastic material or aluminum, a bottom surface 19 and two opposing side surfaces 14. The two opposing side surfaces 14 are generally formed from acrylonitrile butadiene styrene (ABS), while the bottom surface 19 is normally formed from a material resistant to impact and suitable for forming the contact surface with the snow, such as polyethylene. The ski 10 has a core, indicated generally by the numeral 15. Underlying the core is a layer or facing 16 formed from material with a high modulus of elasticity in relation to the core material, such as unidirectional fiberglass or aluminum.

Underlying layer 16 is a layer of rubber foil 20 that extends across the entire width of the ski 10. The rubber foil layer 20 helps bond the steel bottom edges 18 to the layer 16. The rubber foil layer 20 also helps to control the vibrations within the ski 10 during use.

In FIG. 1, the ski 10 has a lower torsional reinforcing layer 22 overlying layer 16 and below the core 15 that is an omnidirectional laminate formed from randomly dispersed fibers of high elastic modulus which are suspended in a matrix formed from a predetermined material. FIG. 2 shows an alternative embodiment with an upper torsional reinforcing layer 21 overlying the core 15 and formed of the same material as the lower torsional reinforcing layer 22. Upper and lower torsional reinforcing layers 21 and 22 may either extend continuously outwardly to form part of the boundary of the sidewalls of the skis 10 seen in FIGS. 1 and 2 or, alternatively, may extend continuously outwardly between the first side and the second opposing side of the ski, not forming a part of the sidewall of the ski.

The predetermined material used as the matrix in which the random fibers of high elastic modulus are suspended in the upper and lower torsional reinforcing layers 21 and 22 may be an epoxy or polyester. These random fibers 28, seen in FIG. 4, form an ommidirectional laminate that increases the torsional stiffness of the ski structure. The particular randomly oriented fibers of high elastic modulus employed may be fiberglass, graphite, boron or a polyamide aromatic sold under the tradename of KEVLAR.

Bottom edges 18 beneath the rubber foil layer 20 may be either a solid edge or a cracked edge, as desired. It is known that a solid edge imparts more vibration to the ski. If the bottom edges 18 are cracked, as is well known in the art, less vibration is transmitted to the ski.

The core 15 is formed from a plurality of layers of aspen and birch which are laminated together so that the layers are generally perpendicular to the top surface 11 and the bottom surface 19. The layers of aspen and birch are alternately laminated together by an appropriate adhesive. In the center of the core 15 is a wedged space 29 that is narrow in the center of the ski 10 but widens as the opposing ends of the ski 10 are approached. Wedged space 29 is a hollow air space into which are emplaced approximately 3 wedges (not shown) so that the core sticks or alternating layers of birch and aspen can be bent or formed during the manufacture of the ski to conform to the side cut or geometry of the ski. It is this side cut and flexural pattern which helps determine the turning radius of a ski.

Figure 3:
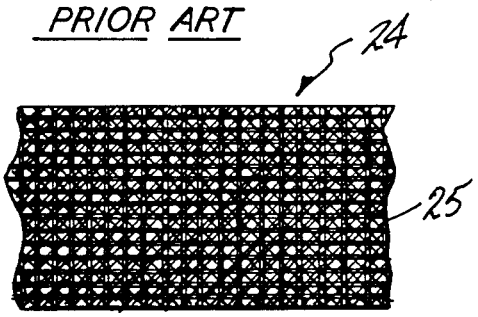
FIG. 3 is a partial diagrammatic view showing the prior art orientation of ±45 degree bias ply laminates used as the torsional reinforcing layer.

FIG. 3 shows a typical prior art torsional reinforcing layer 24 that heretofore has been employed as the upper torsional reinforcing layer 21 and/or the lower torsional reinforcing layer 22. As can be seen, the biased fibers 25 generally run along a plus or minus 45 degree orientation to create a plus or minus 45 degree oriented bias ply fiberglass laminate. The bias fibers 25 typically extend along axes oriented at plus or minus 45 degrees so that the predominate mechanical properties affecting torsional stiffness exist only along these plus or minus 45 degree axes. The predominate mechanical properties do not exist throughout a complete 360 degrees, so that the laminate is not truly an omnidirectional laminate or truly isotropic reinforcing layer. Any reinforcement along other than these principle axes is a minor resultant component of the principle axes.

Figure 4:
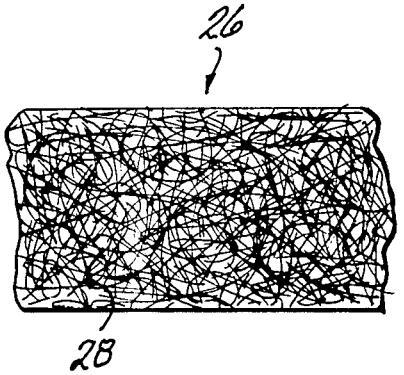
FIG. 4 is a partial diagrammatic view of the random fiber orientation in the torsional reinforcing layer of the present invention.

In contrast, a truly isotropic torsional reinforcing layer or an omnidirectional laminate with fibers of high elastic modulus is shown in FIG. 4 and is indicated generally as a random fiber torsional reinforcing layer 26. The random fibers 28 are shown randomly dispersed in the supporting matrix so that torsional reinforcing occurs along axes at all directions or through 360 degrees. This type of a torsional reinforcing layer exhibits the same mechanical property values, such as tensile strength, compression strength, elastic modulus, shear strength and the coefficient of expansion, when measured along axes in any of the 360 degrees. When the random fiber torsional reinforcing layer 26 is employed as a lower torsional reinforcing layer 22, as seen in FIG. 1, additional strength transverse to the ski's longitudinal axis is imparted that increases the resistance of the bottom edge to side displacement travel and provides higher ski bottom impact strength.

The thickness of the omnidirectional laminate or random fiber torsional reinforcing layer 26 should be such that the average flexural modulus should range between about $1.75\times10^6$ psi and about $2.5\times10^6$ psi. This range permits sufficient torsional stiffness to add to the torsional effects of the core and is still low enough not to contribute to the longitudinal flex of the ski 10. An increase or decrease of thickness for any given laminate type will change the torsional contribution to the ski based on the change in stiffness of the cross-section of the ski. An increase in laminate thickness will also affect the flexural stiffness and torsional stiffness by spacing the higher modulus layers farther from the neutral axis of the ski 10.

The use of a random fiber torsional reinforcing layer 26 comprised of randomly dispersed fibers 28 permits the layer to be manufactured very thinly, such as 0.1 millimeters, and still achieve the necessary torsional stiffness. This permits the torsional stiffness increases or decreases to be controlled in very small increments to enhance the ability to adjust the torsional stiffness of the ski. It also contributes to the design of the ski structure since performance can be optimized by varying independently or jointly longitudinal flex, vibrational characteristics and.torsional stiffness. Torsional stiffness can be adjusted or selectively predetermined, by changing the stiffness of the laminate based on the selection of the particular random fiber and resin matrix to be used and, as previously mentioned, the thickness of the laminate itself.

While the preferred structure in which the principles of the present invention have been incorporated is shown and described above, it is to be understood that the invention is not to be limited to the particular details thus presented, but in fact, widely different means may be employed in the practice of the broader aspects of this invention. For example, two torsional reinforcing layers could simultaneously be employed in the ski, such as one above and one below the core. The scope of the appended claims is intended to encompass all obvious changes in the details, materials and arrangement of parts which will occur to one of skill in the art upon a reading of the disclosure.

Having thus described the invention, what is claimed is:

1. In a snow ski of predetermined length having a core formed from a predetermined material, a top surface, a bottom running surface bounded on its opposing sides by metal edges, and a first side and a second opposing side positioned generally perpendicularly to the top and bottom surfaces and intermediate thereof, the improvement comprising:

at least one isotropic torsional reinforcing precured planar laminate layer intermediate the top surface and bottom running surface and generally parallel thereto extending laterally at least partially between the first side and the second opposing side and longitudinally extending substantially over the predetermined length of the ski, the at least one isotropic torsional reinforcing precured planar laminate layer being independent of the core and formed from fibers of high elastic modulus suspended in a matrix of predetermined material, the fibers being oriented randomly therein to thereby permit the torsional stiffness of the structure to be selectively predetermined.

2. The apparatus according to claim 1 wherein the at least one torsional reinforcing layer is located immediately above the core.

3. The apparatus according to claim 2 wherein the at least one isotropic torsional reinforcing precured planar laminate layer extends continuously between the first side and the second opposing side.

4. The apparatus according to claim 2 wherein the at least one isotropic torsional reinforcing precured planar laminate layer extends continuously outwardly to form part of the first side and the opposing second side.

5. The apparatus according to claim 1 wherein the at least one isotropic torsional reinforcing precured planar laminate layer lies immediately below the core.

6. The apparatus according to claim 5 wherein the at least one isotropic torsional reinforcing precured planar laminate layer lies immediately above a high modulus of elasticity facing layer.

7. The apparatus according to claim 6 wherein the at least one isotropic torsional reinforcing precured planar laminate layer extends continuously between the first side and the second opposing side.

8. The apparatus according to claim 6 wherein the at least one isotropic torsional reinforcing precured planar laminate layer extends continuously outwardly to form part of the first side and the opposing second side.

9. The apparatus according to claim 1 wherein the snow ski further comprises a high modulus of elasticity facing and a rubber layer, respectively, between the core and the bottom running surface.

10. The apparatus according to claim 9 wherein the bottom running surface is formed at least partially from polyethylene.

11. The apparatus according to claim 10 wherein the core is further comprised of birch wood and aspen wood.

12. The apparatus according to claim 11 wherein the fibers of high elastic modulus are fiberglass.

13. The apparatus according to claim 11 wherein the fibers of high elastic modulus are graphite.

14. The apparatus according to claim 1 whereby the torsional stiffness may be designably varied by changing the thickness of the at least one torsional reinforcing layer.

15. The apparatus according to claim 1 whereby the torsional stiffness may be designably varied by changing the randomly oriented fibers of high elastic modulus employed.

16. The apparatus according to claim 1 whereby the torsional stiffness may be designably varied by changing the matrix material in which the randomly oriented fibers are suspended.

17. The apparatus according to claim 1 further comprising a first torsional reinforcing layer located above the core and a second torsional reinforcing layer located below the core.

18. The apparatus according to claim 1 wherein the at least one torsional reinforcing layer has an average flexural modulus of between about $1.75\times10^6$ psi and about $2.5\times10^6$ psi.

* * * * *

UNITED STATES PATENT AND TRADEMARK OFFICE

CERTIFICATE OF CORRECTION

PATENT NO. : 4,679,814

DATED : July 14, 1987

INVENTOR(S) : Meatto et al

It is certified that error appears in the above-identified patent and that said Letters Patent is hereby corrected as shown below:

In column 5, at line 54 after "one" and before "torsional" insert --isotropic--.

In column 5, at line 54 after "reinforcing" and before "layer" insert --precured planar laminate--.

Signed and Sealed this

Twenty-sixth Day of January, 1988

*Attest:*

DONALD J. QUIGG

*Attesting Officer*

*Commissioner of Patents and Trademarks*